US010618326B2

(12) United States Patent
Tamai

(10) Patent No.: US 10,618,326 B2
(45) Date of Patent: Apr. 14, 2020

(54) PRINTING APPARATUS

(71) Applicant: SEIKO EPSON CORPORATION, Tokyo (JP)

(72) Inventor: Satoshi Tamai, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/126,493

(22) Filed: Sep. 10, 2018

(65) Prior Publication Data

US 2019/0077174 A1 Mar. 14, 2019

(30) Foreign Application Priority Data

Sep. 12, 2017 (JP) ..... 2017-174801

(51) Int. Cl.

*B41J 29/13* (2006.01)
*B41J 29/02* (2006.01)
*B41J 2/175* (2006.01)

(52) U.S. Cl.

CPC ..... *B41J 29/02* (2013.01); *B41J 2/17509* (2013.01); *B41J 2/17536* (2013.01); *B41J 29/13* (2013.01); *B41J 2/17513* (2013.01)

(58) Field of Classification Search

None

See application file for complete search history.

(56) References Cited

U.S. PATENT DOCUMENTS

2010/0246109 A1* 9/2010 Matsubara ..... G03G 21/1633 361/679.01

FOREIGN PATENT DOCUMENTS

JP 03-126082 U 12/1991
JP 2010-232296 A 10/2010

* cited by examiner

*Primary Examiner* — Matthew Luu
*Assistant Examiner* — Tracey M McMillion
(74) *Attorney, Agent, or Firm* — Global IP Counselors, LLP

(57) ABSTRACT

A printing apparatus includes a mounting portion in which a container is detachably mounted through an opening, an opening and closing cover that is attached to be rotatable by being bent and deformed and is rotated between an open position where an opening is open and a closed position where the opening is closed around a rotation shaft provided on one end side, a mounting portion side deformation regulating portion (second eaves portion) that is provided on a side of mounting portion, and a cover side deformation regulating portion (protruding portion) disposed to face so as to be capable of coming into contact with the mounting portion side deformation regulating portion when the opening and closing cover is present at the closed position in a case in which the opening and closing cover is bent and deformed is provided on a side of an opening and closing cover.

14 Claims, 13 Drawing Sheets

PRINTING APPARATUS

CROSS REFERENCES TO RELATED APPLICATIONS

The entire disclosure of Japanese Patent Application No. 2017-174801, filed Sep. 12, 2017 is expressly incorporated by reference herein.

BACKGROUND

1. Technical Field

The present disclosure relates to a printing apparatus such as a printer.

2. Related Art

In the related art, there is a printing apparatus such as a printer including a printing unit that prints an image including characters and figures on a medium such as paper by ejecting liquid such as ink. Such a printing apparatus is provided with an opening and closing device including a mounting portion in which a container accommodating a printing-related member (for example, ink) relating to printing by the printing unit is detachably mounted through an opening and an opening and closing cover which opens and closes the opening by being rotated around a rotation shaft.

For example, there is provided an opening and closing device including a front cover (opening and closing cover) in which one end portion is attached to a rotation shaft so as to open and close an opening formed in an ink cartridge charging unit (mounting portion) and a front cover lock projection is disposed on the other end portion, and a push latch device which becomes in a locked state or an unlocked state by pushing the front cover lock projection (refer to JP-A-2010-232296).

Such a front cover (opening and closing cover) of the related art has a configuration in which the other end portion of the front cover where the front cover lock projection is formed can be deformed and, when the other end portion is deformed in a state in which rotation of the front cover is regulated, and the front cover lock projection presses the push latch device, the front cover becomes in the locked state or the unlocked state.

However, in a case in which a portion (for example, one end portion) other than the other end portions in the front cover is also bent and deformed, there is a concern that the rotation shaft is disengaged due to this bending deformation so as to drop out the front cover from the ink cartridge charging unit. For example, in a case in which an end portion side of the front cover at a closed position where the opening is closed is pulled by a user in a direction where the opening is opened, there is a problem in that the rotation shaft positioned in one end portion side of the front cover by bending the front cover is moved in an axial direction so that the front cover and the ink cartridge charging unit are disengaged.

Such a problem is usually common to a printing apparatus including a mounting portion in which a container accommodating a printing-related member relating to printing by the printing unit is detachably mounted through an opening, and an opening and closing cover that opens and blocks the opening by being rotated around a rotation shaft. Particularly, in a case in which the opening and closing cover is formed to be long in a rotation shaft direction, the opening and closing cover is easily bent so as to cause the opening and closing cover to be easily dropped out.

SUMMARY

An advantage of some aspects of the disclosure is to provide a printing apparatus suppressing deviation of an opening and closing cover at a closed position.

Hereinafter, means of the disclosure and operation effects thereof will be described.

According to an aspect of the disclosure, there is provided a printing apparatus including a printing unit that performs printing on a medium, a container that accommodates a printing-related member relating to the printing by the printing unit, a mounting portion that includes an opening and on which the container is detachably mounted through the opening, an opening and closing cover that rotates between an open position where the opening is open and a closed position where the opening is closed around a rotation shaft provided on one end side of the opening and closing cover, in which the mounting portion is provided with a mounting portion side deformation regulating portion, and the opening and closing cover is provided with a cover side deformation regulating portion disposed to face a position where the opening and closing cover comes into contact with the mounting portion side deformation regulating portion in a case in which bending deformation is generated in a direction where the opening and closing cover disposed at the closed position is opened.

In the configuration, since the bending deformation at the closed position is regulated, it is possible to suppress deviation of the opening and closing cover at the closed position.

In the printing apparatus, it is preferable that the cover side deformation regulating portion be provided on the one end side of the opening and closing cover.

In the configuration, the deformation regulating portion in the opening and closing cover is formed near the rotation shaft, and it is possible to suppress the deviation of the opening and closing cover at the closed position with a high probability.

In the printing apparatus, it is preferable that the cover side deformation regulating portion be provided at a position farther toward the one end side of the opening and closing cover than the rotation shaft.

In the configuration, it is possible to suppress the deviation of the opening and closing cover in association with the bending deformation due to a force applied to one end of the opening and closing cover at the closed position.

In the printing apparatus, it is preferable that the opening and closing cover be provided with a hand hooking portion for rotation from the closed position to the open position, and the cover side deformation regulating portion be provided at a position where the hand hooking portion is provided in an axial direction of the rotation shaft.

In the configuration, since bending deformation of the opening and closing cover generated by a force acting on the hand hooking portion is regulated at a position on which the force acts, it is possible to efficiently suppress the deviation of the opening and closing cover at the closed position.

In the printing apparatus, it is preferable that a plurality of the cover side deformation regulating portions be formed along the axial direction of the rotation shaft, and at least one cover side deformation regulating portion be provided at a position where the hand hooking portion is provided in the axial direction of the rotation shaft.

In the configuration, it is possible to stably suppress the deviation of the opening and closing cover at the closed position by the plurality of cover side deformation regulating portions.

In the printing apparatus, it is preferable that the hand hooking portion be provided at a center portion of the opening and closing cover in the axial direction of the rotation shaft.

In the configuration, since the bending deformation is uniformed by a force acting on the hand hooking portion on the opening and closing cover, it is possible to stably suppress the deviation of the opening and closing cover at the closed position.

In the printing apparatus, it is preferable that the opening and closing cover be provided with a rib facing the mounting portion side deformation regulating portion at the open position.

In the configuration, since a gap between the opening and closing cover and the mounting portion side deformation regulating portion is covered at the open position, it is possible to suppress entering of foreign materials.

In the printing apparatus, it is preferable that a mounting portion side rotation regulating portion be provided on a side of the mounting portion, and a cover side rotation regulating portion disposed to face the position where the opening and closing cover comes into contact with the mounting portion side rotation regulating portion in rotation of the opening and closing cover from the closed position to the open position, be provided on a side of the opening and closing cover.

In the configuration, since the rotation of the opening and closing cover at an open position is regulated, it is possible to mount or remove the opening and closing cover by being easily bent and deformed.

In the printing apparatus, it is preferable that the mounting portion side rotation regulating portion be integrally formed with the mounting portion side deformation regulating portion, the mounting portion side deformation regulating portion have a first surface which is disposed to face the cover side deformation regulating portion of the opening and closing cover in a closed state and extend in a direction where the opening and closing cover opens from the mounting portion, and the mounting portion side rotation regulating portion have a second surface which is disposed to face the cover side rotation regulating portion of the opening and closing cover in an open state and extend in a direction intersecting with the direction where the opening and closing cover opens from the first surface of the mounting portion side deformation regulating portion.

In the configuration, it is possible to suppress expansion of a region necessary for providing the deformation regulating portion and the rotation regulating portion in the mounting portion, and to suppress increase of the printing apparatus in size.

In the printing apparatus, it is preferable that, in the mounting portion side rotation regulating portion, when the opening and closing cover is present at the open position, an opposite side on a side facing the cover side rotation regulating portion be a flat surface.

In the configuration, when the opening and closing cover is present at the open position, the container is easily mounted or released to and from the mounting portion.

In the printing apparatus, it is preferable that the cover side rotation regulating portion be provided on the one end side of the opening and closing cover.

In the configuration, since the rotation regulating portion on the opening and closing cover is formed near the rotation shaft, it is possible to suppress expansion of an occupation region in which a rotation regulation portion is provided.

In the printing apparatus, it is preferable that the cover side rotation regulating portion be integrally formed with the cover side deformation regulating portion, and the cover side rotation regulating portion and the cover side deformation regulating portion be provided at positions so as to become a front and a rear in a direction where the opening and closing cover is bent and deformed.

In the configuration, it is possible to suppress the expansion of a region necessary for providing the deformation regulating portion and the rotation regulating portion on the opening and closing cover, and to suppress increase of the printing apparatus in size.

In the printing apparatus, it is preferable that the cover side deformation regulating portion, the cover side rotation regulating portion, and the mounting portion side deformation regulating portion be positioned closer to the one end side of the opening and closing cover than the mounting portion side rotation regulating portion, in rotation of the opening and closing cover between the open position and the closed position.

In the configuration, when the container is attached to and detached from the mounting portion through the opening, it is possible to suppress interfering of the deformation regulating portion or the rotation regulating portion in the attaching or detaching of the container.

In the printing apparatus, it is preferable that the cover side deformation regulating portion and the cover side rotation regulating portion be moved over the rotation shaft in a direction intersecting with an axis of the rotation shaft, in association with the rotation of the opening and closing cover between the open position and the closed position.

In the configuration, since a posture of the deformation regulating portion and the rotation regulating portion on the opening and closing cover side which are moved over the rotation shaft is significantly changed in association with movement, the cover side deformation regulating portion and the cover side rotation regulating portion of the opening and closing cover are easily moved to positions respectively facing the mounting portion side deformation regulating portion and the mounting portion side rotation regulating portion (in addition, the printing apparatus can be made to be compact).

In the printing apparatus, it is preferable that a locking mechanism which regulates rotation of the opening and closing cover from the closed position to the open position be further included, and in the locking mechanism, a displacement member which is disposed at least one end side of both ends of the opening and closing cover in an axial direction of the rotation shaft and constitutes the locking mechanism disposed on any one of sides of the opening and closing cover and the mounting portion, regulate the rotation of the opening and closing cover from the closed position to the open position by being inserted into the other side.

In the configuration, it is possible to suppress rotating and moving of the opening and closing cover at the closed position from the closed position to the open position.

BRIEF DESCRIPTION OF THE DRAWINGS

The disclosure will be described with reference to the accompanying drawings, wherein like numbers reference like elements.

DESCRIPTION OF EXEMPLARY EMBODIMENTS

Hereinafter, an embodiment of a printing apparatus will be described with reference to drawings.

Figure 1:
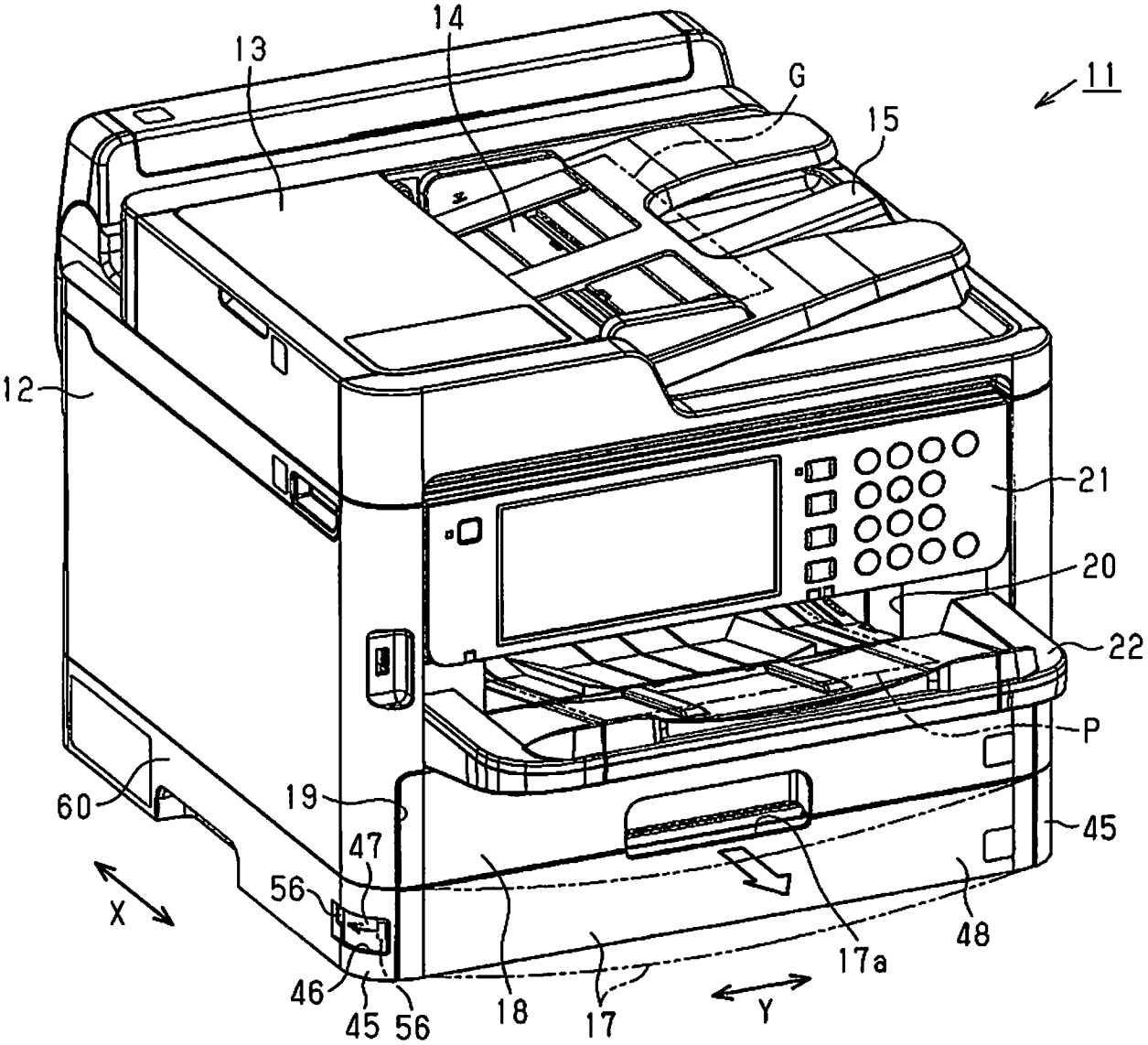
FIG. 1 is a perspective view illustrating a printing apparatus of an embodiment.

As illustrated in FIG. 1, a printing apparatus 11 of the embodiment is, for example, an ink jet type printer, and includes a case 12 as an apparatus main body having a predetermined length such as a height, a depth, and a width in a provided state at a horizontal location where the apparatus is used, and an original document reading device including an automatic original document sending device 13 disposed in the case 12.

The automatic original document sending device 13 including a setting portion 14 capable of setting a plurality of original documents G in a stacked state and a discharging portion 15 disposed on a lower side of the setting portion 14. Also, the plurality of original documents G which is set in the setting portion 14 in the stacked state is read by a reading unit 16 (refer to FIG. 3) disposed on an upper end portion inside the case 12 in a procedure of being reversely sent to the discharging portion 15 sequentially through an original document sending path (not illustrated).

On a front surface of the case 12, in order from a bottom portion side to the top, an opening and closing cover 17, a mounting port 19 in which a paper cassette 18 accommodating paper P as an example of a medium is detachably mounted, a discharging port 20 through which the printed paper P is discharged, and an operation unit 21 with which a user performs various operations are provided. Further, on the front surface of the case 12, a discharging tray 22 which supports the printed paper P discharged from the discharging port 20 is detachably mounted so as to protrude from a front side. Also, the front surface of the case 12 is a side surface which has a height and a width and where a user mainly operates of the printing apparatus 11.

In addition, in the case 12, a part adjacent to a right side and a left side of the opening and closing cover 17 toward the front surface of the case 12 is a cover adjacent portion 45. The cover adjacent portion 45 is positioned at a corner portion of the case 12. In the embodiment, a substantially rectangular shaped opening portion 46 which extends to be bent along a curve of the corner portion of the case 12 is formed on the cover adjacent portion 45 adjacent to a left side of the opening and closing cover 17 toward the front surface of the case 12. Also, inside the cover adjacent portion 45, a displacement member 47, in which a finger hooking portion 56 exposed through the opening portion 46 is provided, is provided to be capable of reciprocating (be displaceable) along the curve of the corner portion of the case 12. The displacement member 47 is displaced between a side surface (front surface) in which the opening and closing cover 17 is provided in the case 12 and a side surface (side surface of left side toward front surface in FIG. 1) adjacent to the side surface (front surface).

Figure 2:
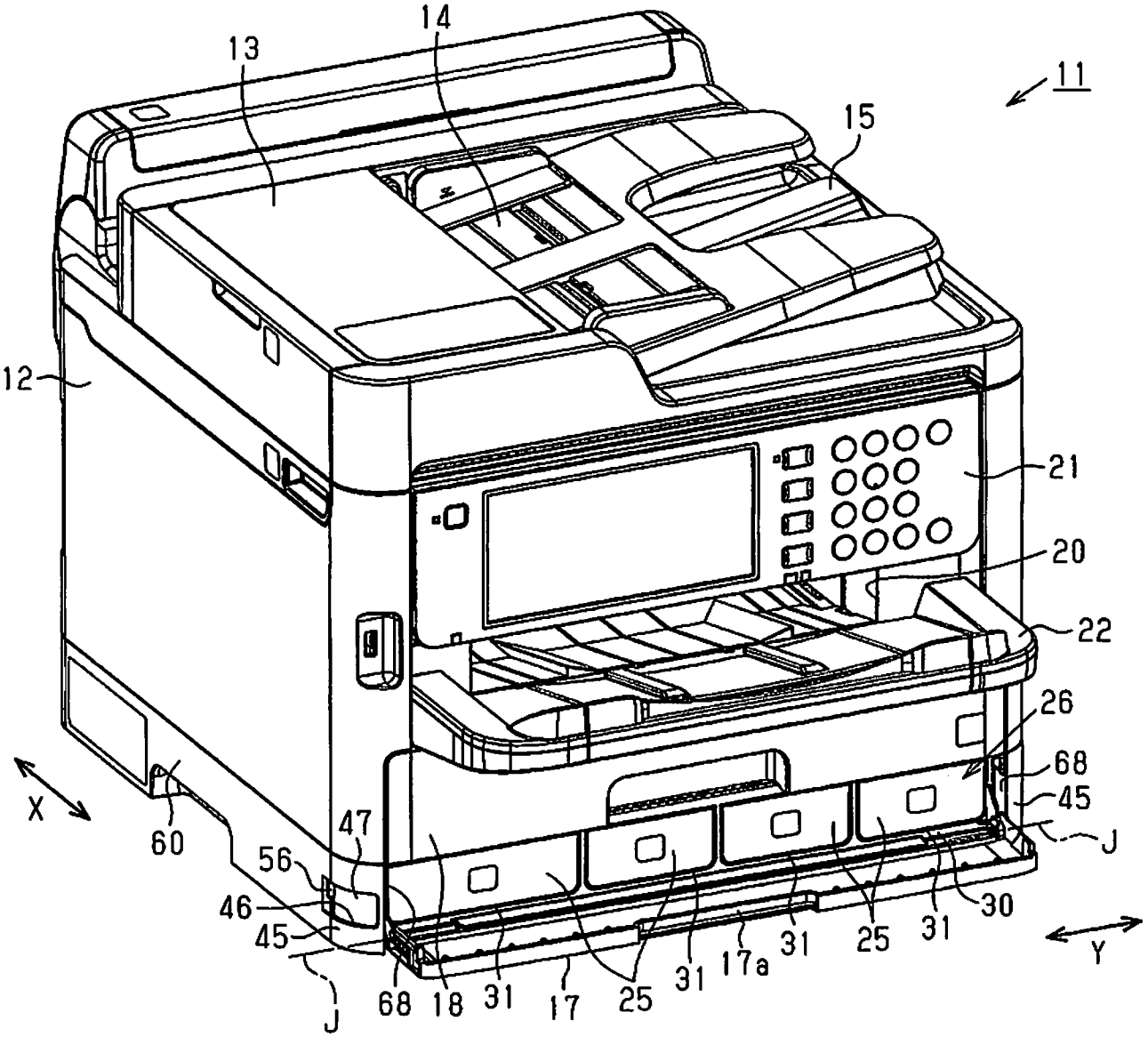
FIG. 2 is a perspective view illustrating the printing apparatus in which an opening and closing cover is present at an open position.

As illustrated in FIGS. 1 and 2, in the opening and closing cover 17, a rotation shaft J is provided on one end side (bottom portion side of case 12) in a height direction, and a hand hooking portion 17*a* is provided on the other end side opposite to the one end side in the height direction (upper portion side of case 12) are provided. Also, when a user puts his or her hand on the hand hooking portion 17*a* and pulls the other end side toward a front side (near side (arrow direction of FIG. 1)) of the case 12, the opening and closing cover 17 becomes from a state in which a mounting portion 26 is covered as illustrated in FIG. 1 to a state in which the mounting portion 26 is exposed as illustrated in FIG. 2 by being rotated around the rotation shaft J.

Figure 3:
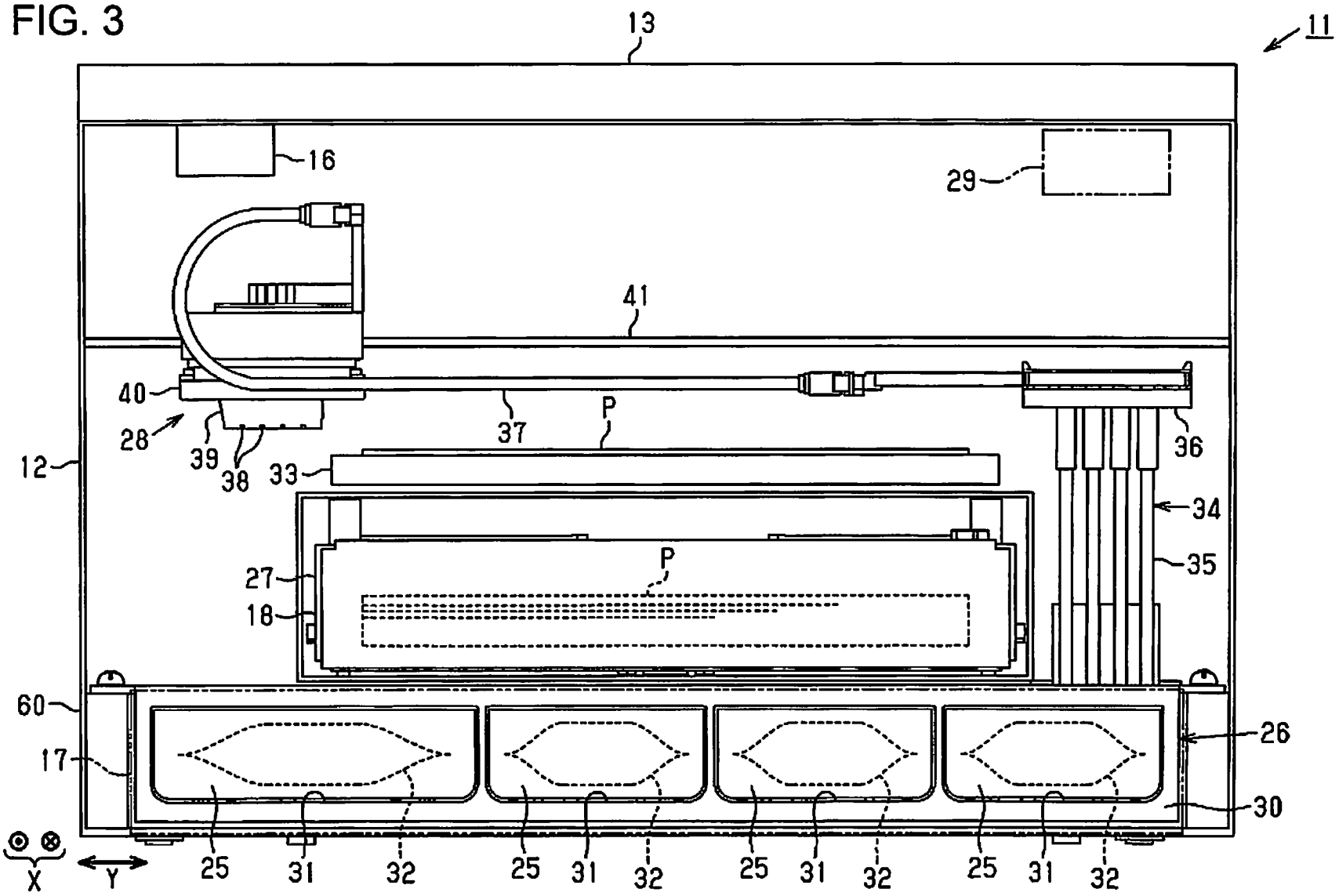
FIG. 3 is a plan view schematically illustrating an inner structure of the printing apparatus.

As illustrated in FIGS. 2 and 3, the mounting portion 26 includes a frame 30 which is attached to a mounting portion case 60 constituting a bottom portion side of the case 12 and constitutes an accommodating space where one or more containers 25 are accommodated. The frame 30 includes four openings communicating with the near side (front side) in the accommodating space, and each opening constitutes an inserting hole 31. That is, the four container 25 are respectively inserted into the accommodating space through four inserting holes 31 and are detachably mounted in the mounting portion 26. The front surface of the four inserting holes 31 is covered to be openable with the opening and closing cover 17 which is rotatable between an open position where the inserting hole 31 through which the mounting portion 26 becomes in a state (state illustrated in FIG. 2) of being exposed is open and a closed position where the inserting hole 31 is covered in a state (state illustrated in FIG. 1) in which the mounting portion 26 is covered.

Also, in the embodiment, when the container 25 can be inserted to and removed from the inserting hole 31, a direction where the container 25 is inserted to and removed from the inserting hole 31 is set to a depth direction X, and a direction orthogonal to the depth direction X is set to a width direction Y. The width direction Y and the depth direction X are substantially along a horizontal surface. Also, the four inserting holes 31 are arranged in parallel along the width direction Y.

Each container 25 accommodates bags 32 which are substantially rectangular parallelepiped and have a flexibility for accommodating ink as an example of a printing-related member relating to printing by a printing unit 28. Ink having different colors (in the embodiment, black, cyan, magenta, and yellow) are respectively accommodated in the bags 32 accommodated in each of the four container 25.

In this case, since black ink is frequently used, widths of the bag 32 accommodating the black ink and the container 25 accommodating the bag 32 are wider than those of the bag 32 accommodating ink other than the black ink and the container 25 accommodating the bag 32. In the embodiment, the container 25 accommodating the bag 32 accommodating the black ink is inserted into the inserting hole 31 positioned on a left end in FIG. 3. Also, a width of each inserting hole 31 is matched to the width of the container 25 to which the hole is inserted.

In addition, as illustrated in FIG. 3, the printing apparatus 11 includes a paper accommodating portion 27 which is a part for accommodating the paper P in the paper cassette 18 and the printing unit 28 which performs printing on the paper P inside the case 12.

A supporting board 33 which supports the paper at a position facing within a range of reciprocating when the printing unit 28 performs printing is disposed on the paper accommodating portion 27 inside the case 12. A plurality of the paper P accommodated in the stacked state inside the paper accommodating portion 27 is reversely transported by a transporting portion (not illustrated) one by one on the supporting board 33. In addition, a supply mechanism 34 which supplies ink inside the container 25 mounted in the mounting portion 26 by driving a supply pump (not illustrated) to the printing unit 28 is provided inside the case 12.

The supply mechanism 34 includes a supply tube 35 in which one end side is connected to the mounting portion 26, a joint portion 36 connected to the other end side of the supply tube 35, and a flexible tube 37 in which one end side is connected to the joint portion 36 and the other end side is connected to the printing unit 28. Four supply mechanisms 34 are disposed inside the case 12 so as to respectively correspond to the four container 25.

The printing unit 28 includes a recording head 39 including a plurality of nozzles 38 which ejects each ink being supplied through each supply mechanism 34 inside each container 25 and a carriage 40 which supports the recording head 39. The carriage 40 is supported to be capable of reciprocating around a guide shaft 41 which is installed inside the case 12 and extends in the width direction Y. That is, the carriage 40 reciprocates along the width direction Y.

Also, when ink is ejected from each nozzle 38 of the recording head 39 to the paper P transported onto the supporting board 33 while the carriage 40 reciprocates along the guide shaft 41 in the width direction Y, printing is performed on the paper P. In this case, each flexible tube 37 is bent and displaced following reciprocation of the carriage 40. The printed paper P is discharged onto the discharging tray 22 from the discharging port 20 (refer to FIG. 1). Also, the printing apparatus 11 includes a control unit 29 that controls the entire operations relating to printing by the printing apparatus 11 at a certain position inside the case 12.

Next, a configuration relating to the mounting portion 26 and the opening and closing cover 17 will be described.

Figure 4:
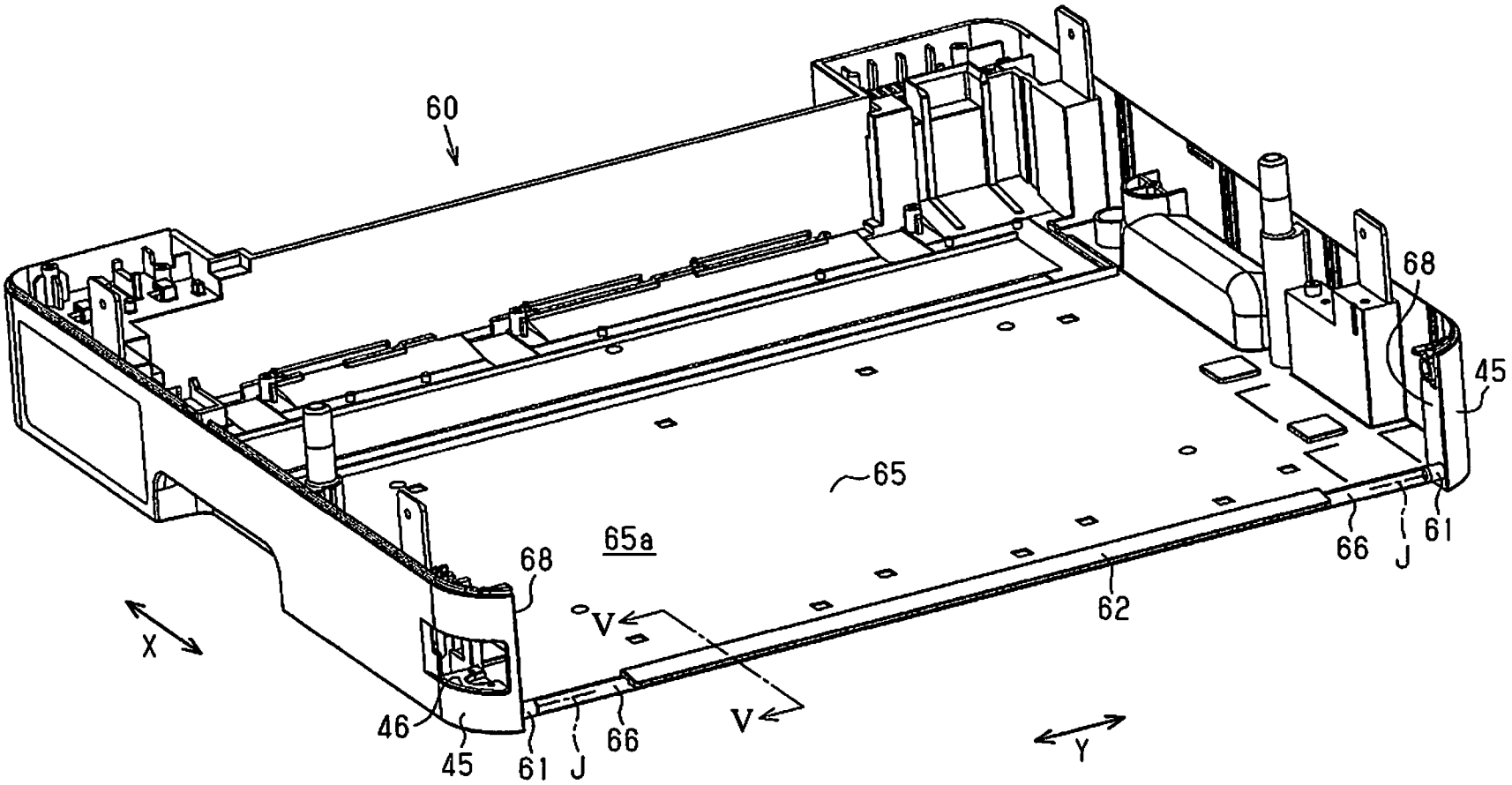
FIG. 4 is a perspective view illustrating a mounting portion case to which a mounting portion of a container accommodating a printing-related member is attached.

As illustrated in FIGS. 2 and 4, the mounting portion case 60 is a substantially bottomed box shaped member (exterior component) including a bottom plate portion and in which an upper surface and a front surface are opened. Both ends in an opening of a front surface side in the width direction Y are side wall surfaces 68 of the cover adjacent portion 45, and the frame 30 constituting the mounting portion 26 is attached to the mounting portion case 60 so that an opening of a front surface of the mounting portion case 60 faces an opening of a front surface of the inserting hole 31 to which the container 25 is inserted.

As illustrated in FIG. 4, in the mounting portion case 60, a shaft pin 61 protruding in a cylindrical shape or in a column shape in which a distal end is chamfered from the side wall surface 68 inwardly along the width direction Y is formed in each the cover adjacent portion 45. In addition, in the mounting portion case 60, an eaves shaped portion 62, which protrudes along the depth direction X forward with a predetermined length and extends in the width direction Y with a predetermined length, is formed on a front side end of the bottom plate portion 65.

Figure 5:
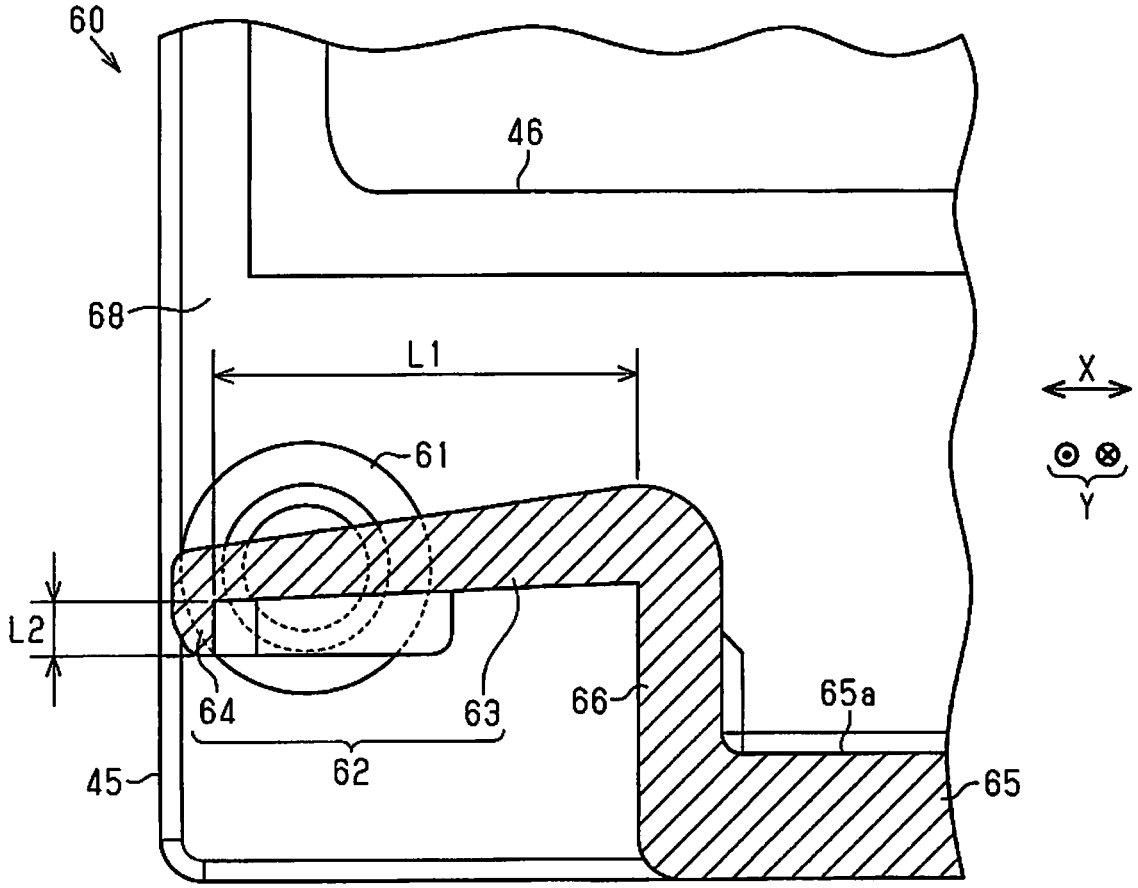
FIG. 5 is a sectional view of the mounting portion case taken along V-V arrow line in FIG. 4.

As illustrated in FIGS. 4 and 5, the front side end of the bottom plate portion 65 of the mounting portion case 60 is a front side wall 66 which is bent upwardly with respect to a bottom surface 65*a* at a substantially right angle. The eaves shaped portion 62 includes a first eaves portion 63 which protrudes from an upper end of the front side wall 66 forwardly by a length L1, and a second eaves portion 64 which protrudes from a distal end which is a front side end of the first eaves portion 63 toward a lower side in a height direction by a length L2. That is, the first eaves portion 63 is integrally formed with the second eaves portion 64, and the second eaves portion 64 is formed on the distal end of the first eaves portion 63. Therefore, a shape (sectional surface shape) of the eaves shaped portion 62 seen from the width direction Y is L-letter shaped. In addition, the upper surface of the eaves shaped portion 62 is a flat surface inclined downwardly with respect to the front.

Figure 6:
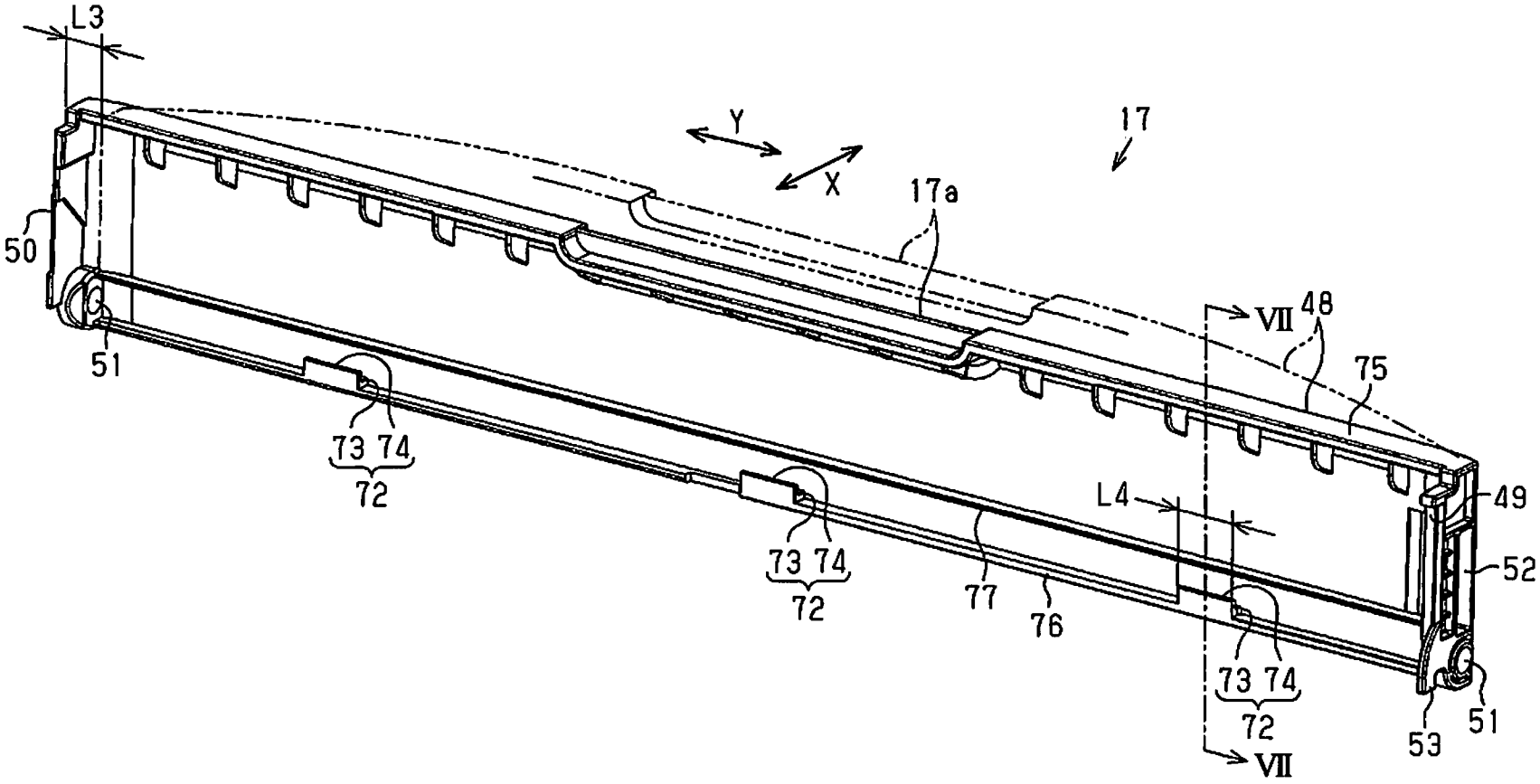
FIG. 6 is a perspective view illustrating the opening and closing cover.

As illustrated in FIGS. 2 and 6, the opening and closing cover 17 is a bottomed rectangular box shape having the main wall 48, which is a long rectangular shape in the width direction Y, as a bottom, and the main wall 48 is exposed along a vertical surface in a state (state illustrated in FIG. 1) in which the opening and closing cover is present at the closed position. In two side walls facing the opening and closing cover 17 in the width direction Y, one provided with the opening portion 46 and positioned on a cover adjacent portion 45 side is a first side wall 49, and the other positioned on an opposite side is a second side wall 50.

As illustrated in FIGS. 4 and 6, in a state in which the opening and closing cover 17 is present at the closed position, round hole shaped bearing portions 51 penetrate through a lower end portion of the first side wall 49 and the second side wall 50 so as to be formed as a pair. A pair of the shaft pins 61 protruding from the cover adjacent portion 45 of the mounting portion case 60 in the width direction Y is respectively inserted into a pair of the bearing portions 51, and the opening and closing cover 17 is supported to be rotatable with respect to the pair of shaft pins 61 by the pair of bearing portions 51. That is, the opening and closing cover 17 in which the shaft pin 61 is inserted into the bearing portion 51 is rotatably attached to the mounting portion 26 side around a center shaft of the shaft pin 61 extending in the width direction Y as the rotation shaft J.

The opening and closing cover 17 is formed as a member having elasticity, as illustrated by a two-dot chain line in FIG. 6, the main wall 48 can be bent and deformed in a state of being curved from a protrusion in a longitudinal direction so that a distance between the pair of bearing portions 51 is shortened in the longitudinal direction (width direction Y). Therefore, in the embodiment, when the distance between the pair of bearing portions 51 which is bent and deformed is shortened by a length L3, the pair of shaft pins 61 protruding from the mounting portion case 60 can be respectively inserted with respect to each bearing portion 51. After that, the opening and closing cover is attached to be rotatable with respect to the mounting portion case 60 (printing apparatus 11) which is the mounting portion 26 side when the bending deformation is recovered (refer to FIG. 2).

Figure 7:
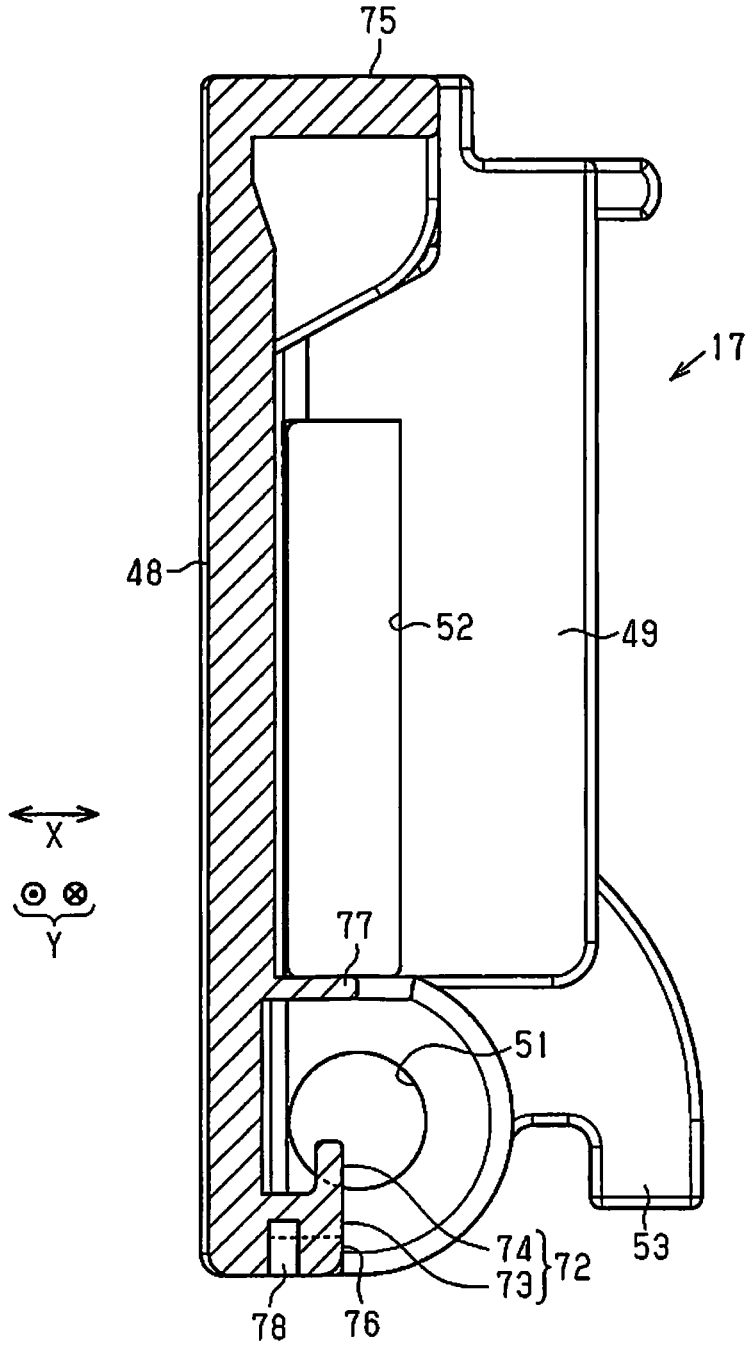
FIG. 7 is a sectional view of the opening and closing cover taken along VII-VII arrow line in FIG. 6.

As illustrated in FIGS. 6 and 7, on the main wall 48 of the opening and closing cover 17, a rib 77 extending in the width direction Y is formed on a rear surface side opposite to the front surface side exposed in a state of being present at the closed position. In addition, in a state in which the opening and closing cover 17 is present at the closed position, a plurality (here, three) of protrusion shaped portions 72 having a length L4 in the width direction Y is provided on a lower side wall 76 positioned on a lower end of the main wall 48 on one end side (bottom portion side of case 12) in a height direction of the opening and closing cover 17. The hand hooking portion 17*a* is provided on an upper side wall 75 positioned on an upper end of the main wall 48 on the other end side of the opening and closing cover 17 in the height direction. In the embodiment, the hand hooking portion 17*a* is provided at the center portion of the opening and closing cover 17 in the width direction Y (axial direction of rotation shaft J), and at least one (here, center) of the protrusion shaped portions 72 is provided at a position where the hand hooking portion 17*a* is provided in the width direction Y.

Each protrusion shaped portion 72 includes a thick side wall portion 73 in which a wall thickness on a lower side wall 76 is thickened inwardly (upwardly) by a predetermined size, and a protruding portion 74 protruding upwardly from an end portion opposite to the main wall 48 side on the thick side wall portion 73 in a state in which the opening and closing cover 17 is present at the closed position. Also, in the embodiment, as illustrated in FIG. 7, as necessary for a reason of manufacturing (for example, preventing shrinkage at the time of molding), a groove 78 having a predetermined width and a predetermined depth in the thick side wall portion 73 is formed with a predetermined length along the width direction Y.

Figure 8:
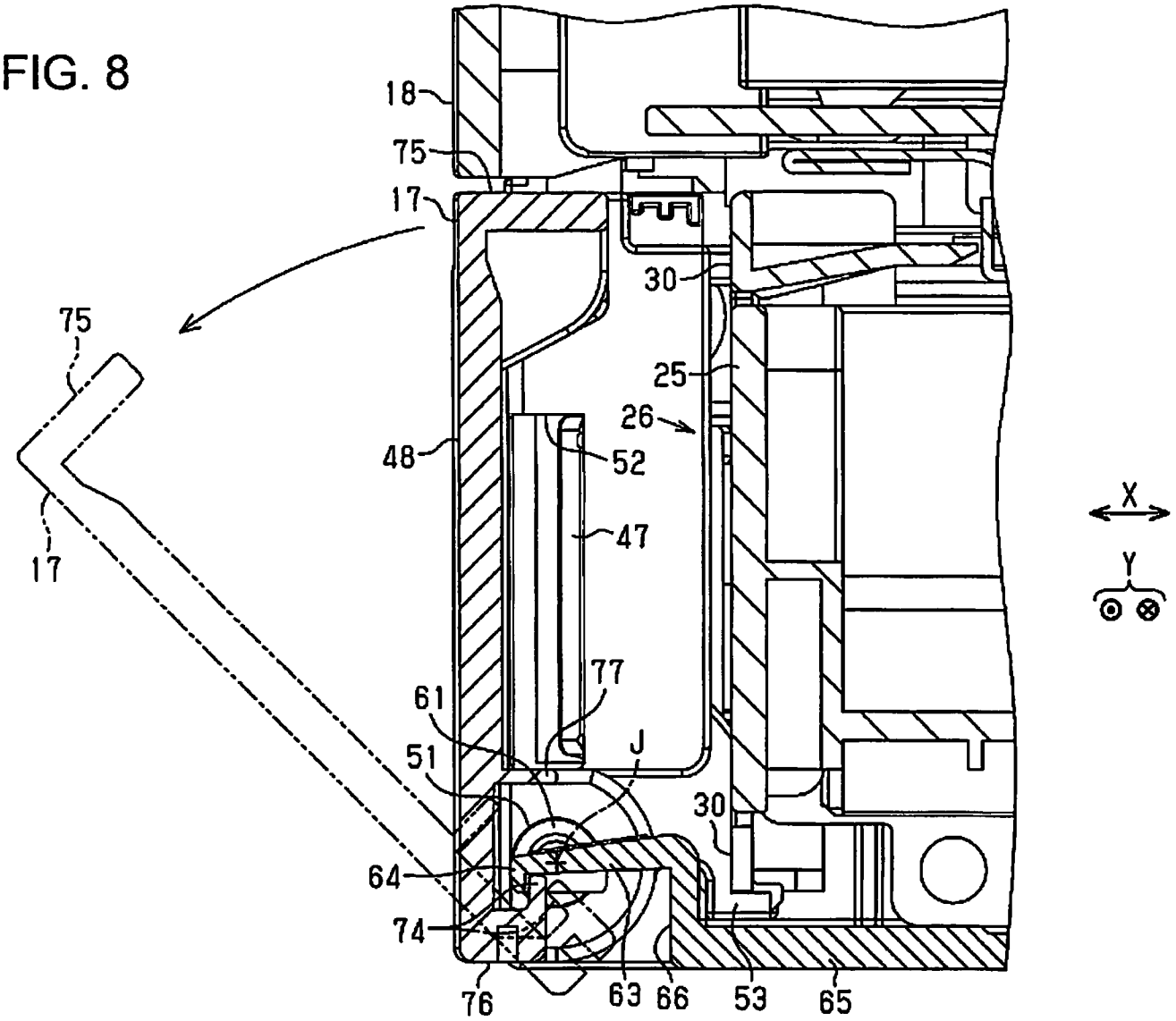
FIG. 8 is a side sectional view illustrating a part of the opening and closing cover at a closed position and the mounting portion.

As illustrated in FIG. 8, in a state in which the opening and closing cover 17 which is attached to be rotatable with respect to the shaft pin 61 by the bearing portion 51 is present at the closed position, each protruding portion 74 is disposed in the opening and closing cover 17 so that a front surface thereof faces the second eaves portion 64 in the depth direction X in a state in which a gap is not included or a gap is slightly included. That is, each protruding portion 74 is positioned within an extension range of the eaves shaped portion 62 of the mounting portion case 60 in the width direction Y. In addition, each protruding portion 74 is provided at a position farther toward the one end side of the opening and closing cover 17 than the center shaft of the shaft pin 61 (rotation shaft J) on one end side of the opening and closing cover 17. Therefore, as illustrated by a two-dot chain line in FIG. 8, when the upper side wall 75 side in which the hand hooking portion 17*a* is provided on the other end side is moved around the shaft pin 61, the opening and closing cover 17 is rotated from the closed position to the open position. At this time, each protruding portion 74 is moved so that the front surface thereof facing the second eaves portion 64 is distant from a lower side and a rear side, and becomes in a state of not facing the second eaves portion 64, in accordance with rotation of the opening and closing cover 17 from the closed position toward the open position.

Figure 9:
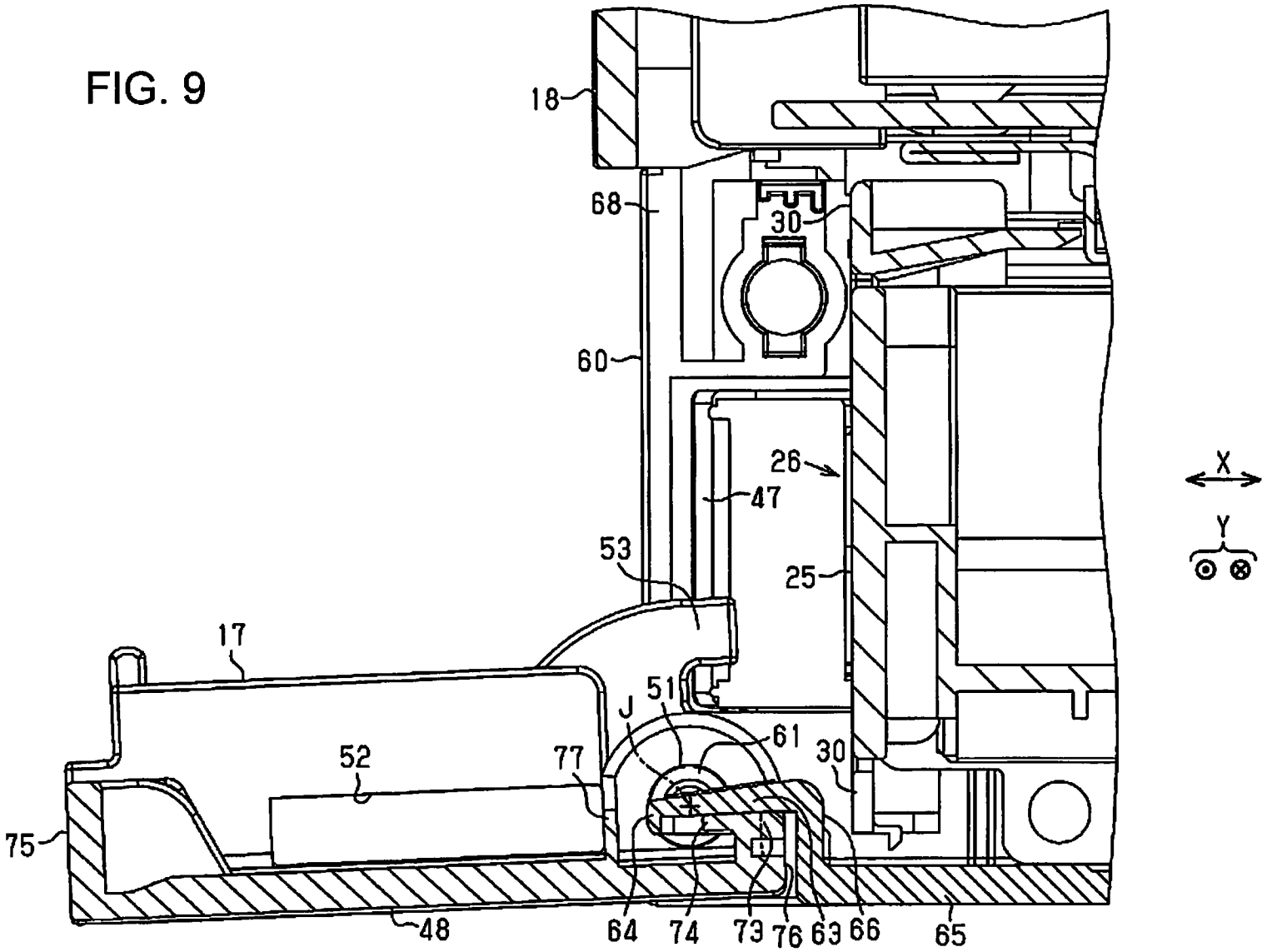
FIG. 9 is a side sectional view illustrating a part of the opening and closing cover at the open position and the mounting portion.

As illustrated in FIG. 9, in the embodiment, the opening and closing cover 17 is moved (rotated) from the closed position to the open position by rotating the upper side wall 75 side around the shaft pin 61 at approximately 90 degrees in a forward direction. Also, in the rotation from the closed position to the open position of the opening and closing cover 17, a rear surface of each protruding portion 74, which has a front and rear relationship with a front surface thereof facing the second eaves portion 64, faces the first eaves portion 63 of the mounting portion case 60 and comes into contact with (contact in an abutment state) the first eaves portion 63 at the open position of the opening and closing cover 17. In other words, a position where the rear surface of at least one of the protruding portions 74 comes into contact with the first eaves portion 63 becomes the open position of the opening and closing cover 17.

In addition, as illustrated in FIGS. 6 and 7, in a state in which the opening and closing cover 17 is present at the closed position, a rectangular shaped through hole 52 is formed at a position of the first side wall 49 which is adjacent to the bearing portion 51 on an upper side. In addition, the displacement regulating portion 53 protrudes toward the depth side (rear side) at a position of the first side wall 49 which is adjacent to the bearing portion 51 on a depth side (opposite side of main wall 48 side). As illustrated in FIGS. 8 and 9, a displacement regulating portion 53 is moved to a position of the through hole 52 when the opening and closing cover 17 is present at the closed position by rotating the opening and closing cover 17 from the closed position to the open position.

Figure 10:
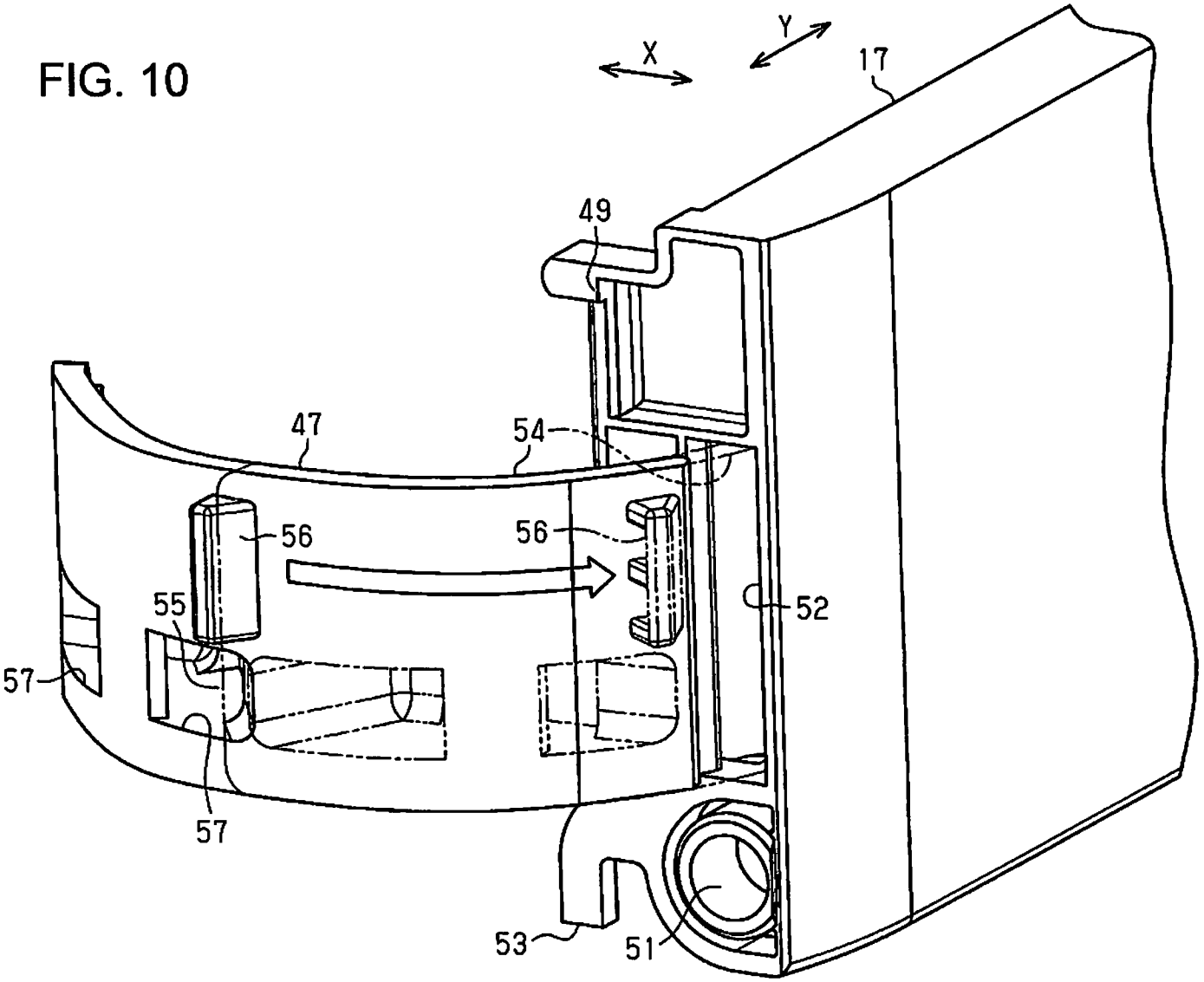
FIG. 10 is a perspective view illustrating an enlarged main part including a displacement member.
Figure 11:
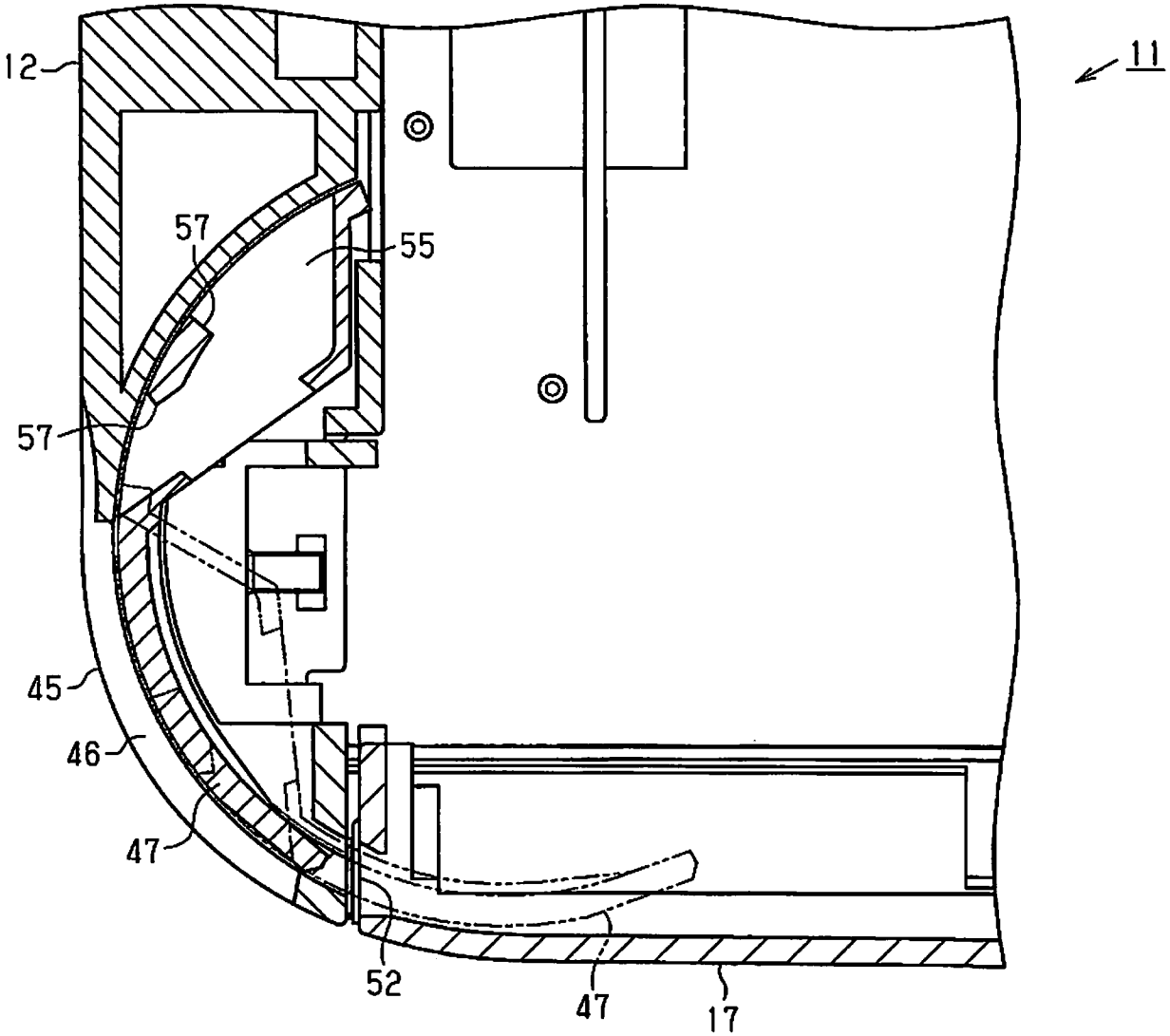
FIG. 11 is a sectional plan view illustrating the enlarged main part including the displacement member.

As illustrated in FIGS. 10 and 11, the displacement member 47 which is provided to be displaceable along the curve of the corner portion of the case 12 includes a strip shaped main body portion 54 extending to be curved along the curve of the corner portion of the case 12, and a horizontal portion 55 in a substantially fan shape formed on an end portion of an opposite side of the opening and closing cover 17 side on a lower end portion of the main body portion 54.

The finger hooking portion 56 as an example of the operation unit to which a user hooks his or her finger protrudes from an upper portion of a center portion of the main body portion 54 in a longitudinal direction, at the time of moving the displacement member 47. That is, the finger hooking portion 56 is operated by a user in order to displace the displacement member 47 in the longitudinal direction.

Because of the operation of the finger hooking portion 56, as illustrated by a solid line and a two-dot chain line in FIG. 10, the displacement member 47 is displaced in a direction (preferably, direction orthogonal to opening and closing direction) intersecting with an opening and closing direction where the opening and closing cover 17 is rotated between the closed position and the open position. Also, a distal end of the finger hooking portion 56 is preferably positioned at the same position as an outer surface of the case 12 or on a slightly inside of the outer surface.

A pair of openings 57 arranged in the longitudinal direction of the main body portion 54 are formed on an upper side of the horizontal portion 55 in the main body portion 54. The pair of openings 57 penetrates from the upper side of the horizontal portion 55 so as to be linear with each other. That is, the pair of openings 57 can be linearly connected to one another from the upper side of the horizontal portion 55. Here, it is not illustrated, but for example, it is possible to penetrate a shackle of a padlock or a wire of a wire lock through the pair of openings 57. That is, for example, a regulating member such as a padlock or a wire lock can be attached to the pair of openings 57.

The displacement member 47 is displaced between a locking position (position illustrated by two-dot chain line in FIGS. 9 and 10) where an opening operation (rotation from closed position to open position) of the opening and closing cover 17 is regulated by being engaged with the through hole 52 of the opening and closing cover 17 at the closed position and a unlocking position (illustrated by solid line in FIGS. 9 and 10) where the opening operation of the opening and closing cover 17 is allowed by being separated from the through hole 52.

That is, the displacement member 47 reciprocates between the locking position where a part of through hole 52 of the opening and closing cover 17 at the closed position is inserted and the opening operation of the opening and closing cover 17 is regulated and the unlocking position where the opening operation of the opening and closing cover 17 is allowed by being evacuated from the through hole 52. In other words, the displacement member 47 constitutes the a locking mechanism of the printing apparatus 11 that regulates rotation of the opening and closing cover 17 from the closed position to the open position by being inserted from one side (here, mounting portion 26 side) to the other side (here, opening and closing cover 17 side) between the opening and closing cover 17 side and the mounting portion 26 side.

As illustrated in FIG. 8, when the opening and closing cover 17 is present at the closed position, for example, in a case in which a user inadvertently pulls a lower end (lower side wall 76) of the opening and closing cover 17 toward a near side in the depth direction X instead of the hand hooking portion 17*a* on an upper end side, a force to bend the main wall 48 in a curved shape of protrusion forward is applied to the opening and closing cover 17.

At this time, each protruding portion 74 of the three protrusion shaped portions 72 provided in the opening and closing cover 17 is provided on a lower end side (one end side) the same as a position where the bearing portion 51 of the opening and closing cover 17 is provided, and is disposed to face the second eaves portion 64 (surface of rear side of the second eaves portion 64 in apparatus) of the mounting portion case 60 on a front side which becomes a bending direction of the opening and closing cover 17. Therefore, in a case in which the opening and closing cover 17 is bent and deformed due to the force acting on a lower end (lower side wall 76), a front surface of at least one of the protruding portion 74 comes into contact with the second eaves portion 64 facing the protruding portion in a state in which there is no gap or a gap is slightly present in the depth direction X which is a bending direction, and the protruding portion 74 regulates bending deformation of the opening and closing cover 17. As a result, releasing of the shaft pin 61 from the bearing portion 51 is suppressed. Therefore, the second eaves portion 64 functions as a mounting portion side deformation regulating portion, and the front surface of the protruding portion 74 functions as a cover side deformation regulating portion. In other words, the second eaves portion 64 which is an example of the mounting portion side deformation regulating portion is provided on the mounting portion side, and the protruding portion 74, which is an example of the cover side deformation regulating portion, disposed to face and to be capable of coming into contact with the second eaves portion 64 when the opening and closing cover 17 is present at the closed position in a case in which the opening and closing cover 17 is bent and deformed is provided on the opening and closing cover 17 side.

Also, in FIG. 8, the displacement member 47 is present at the unlocking position, but in the printing apparatus 11, for example, the displacement member 47 is present at the locking position so that a third party cannot easily open the opening and closing cover 17 in order to suppress being exchanged or stolen of the container 25 mounted in the mounting portion 26 without permission. Therefore, in a state of the locking position where the displacement member 47 is inserted into the through hole 52 of the opening and closing cover 17, it is not limited to the lower end of the opening and closing cover 17, the opening and closing cover 17 is bent and deformed in a curved shape of protrusion on a front side (in direction where opening and closing cover 17 is opened) of a longitudinal direction (width direction Y) as illustrated by a two-dot chain line in FIG. 1 due to a force acting on an upper end (hand hooking portion 17*a*) as illustrated by an outline arrow in FIG. 1. In the embodiment, even in such a case, the protruding portion 74 comes into contact with the second eaves portion 64, and bending deformation of the opening and closing cover 17 is regulated.

Meanwhile, as illustrated in FIG. 9, when the opening and closing cover 17 is present at the open position, the protruding portion 74 of the protrusion shaped portion 72 provided on the opening and closing cover 17 does not face the second eaves portion 64 of the mounting portion case 60 on a lower side which is a bending direction of the opening and closing cover 17. Therefore, the opening and closing cover 17 can be bent and deformed in a curved shape in which the main wall 48 protrudes downwardly, a user takes out the opening and closing cover 17 from the mounting portion case 60 by extracting the bearing portion 51 from the shaft pin 61 using the bending deformation, or conversely, the opening and closing cover 17 can be attached to the mounting portion case 60 by inserting the shaft pin 61 into the bearing portion 51.

Also, the open position of the opening and closing cover 17 is a position where the rear surface of the protruding portion having a front and rear relationship with the front surface of the protruding portion 74 facing the second eaves portion 64 comes into contact with the first eaves portion 63 (surface on lower side of first eaves portion 63 in apparatus) of the mounting portion case 60 so as to regulate the rotation. Therefore, the first eaves portion 63 functions as a mounting portion side rotation regulating portion, and the rear surface of the protruding portion 74 functions as a cover side rotation regulating portion.

In other words, the mounting portion side rotation regulating portion is provided on the mounting portion 26 side, and the cover side rotation regulating portion, which is disposed to face and be capable coming into contact with the mounting portion side rotation regulating portion in the rotation of the opening and closing cover from the closed position to the open position, is provided on the opening and closing cover 17 side. The first eaves portion 63 which is an example of the mounting portion side rotation regulating portion is formed to be integral with the second eaves portion 64 which is an example of the mounting portion side deformation regulating portion, and the mounting portion side deformation regulating portion is provided on a distal end of the mounting portion side rotation regulating portion. Further, the cover side rotation regulating portion which is formed to be integral with the cover side deformation regulating portion is provided at a position where the cover side rotation regulating portion and the cover side deformation regulating portion becomes a front and a rear in a direction where the opening and closing cover 17 is bent and deformed.

In addition, as illustrated in FIGS. 8 and 9, the protruding portion 74, which is an example of the cover side deformation regulating portion and the cover side rotation regulating portion, is moved over the rotation shaft J in a direction (here, depth direction X) intersecting with an axis of the rotation shaft J in accordance with rotation between the open position and the closed position of the opening and closing cover 17. Therefore, a posture of the protruding portion 74 is significantly changed in association with the opening and closing cover 17.

Further, in the embodiment, the protruding portion 74 which is an example of the cover side deformation regulating portion and the cover side rotation regulating portion and the second eaves portion 64 which is an example of the mounting portion side deformation regulating portion is positioned on one end side (lower end side) of the first eaves portion 63 which is an example of the mounting portion side rotation regulating portion in the rotation of the opening and closing cover 17 between the open position and the closed position. Therefore, when the container 25 is attached to and detached from the mounting portion 26 through an opening (inserting hole 31), it is possible to suppress interfering of the deformation regulating portion or the rotation regulating portion in attaching and detaching of the container 25.

In addition, in the embodiment, the rib 77 provided in the opening and closing cover 17 faces the second eaves portion 64 which is an example of the mounting portion side deformation regulating portion, when the opening and closing cover 17 is present at the open position. Therefore, a gap between the opening and closing cover 17 at the open position and the mounting portion side deformation regulating portion is covered with the rib 77.

In addition, in the first eaves portion 63 which is an example of the mounting portion side rotation regulating portion, when the opening and closing cover 17 is present at the open position, since an opposite side on a side facing the protruding portion 74 is a flat surface, the opening and closing cover 17 at the open position does not interfere in mounting or releasing of the container 25 in and from the mounting portion 26.

Hitherto, according to the above-described embodiment, effects as follows can be obtained.

(1) In a case in which the opening and closing cover 17 is bent and deformed when the opening and closing cover 17 is present at the closed position, since the protruding portion 74 disposed to face the opening and closing cover comes into contact with the second eaves portion 64, the bending deformation of the opening and closing cover 17 at the closed position is regulated, and thus it is possible to suppress deviation of the opening and closing cover 17 at the closed position.

(2) Since the cover side deformation regulating portion is provided on one end side (lower end side) of the opening and closing cover 17, the deformation regulating portion in the opening and closing cover 17 is formed near the rotation shaft J, and thus it is possible to suppress the deviation of the opening and closing cover 17 at the closed position with a high probability.

(3) Since the protruding portion 74 is provided at a position farther toward one end side (lower end side) of the opening and closing cover 17 than the rotation shaft J, it is possible to suppress the deviation due to the bending deformation by a force to be applied to one end (lower end) of the opening and closing cover 17 at the closed position.

(4) Since the protruding portion 74 is provided at a position where the hand hooking portion 17*a* is provided in the axial direction of the rotation shaft J, the bending deformation of the opening and closing cover 17 by the force acting on the hand hooking portion 17*a* is regulated at a position on which the force acts. As a result, it is possible to efficiently suppress the deviation of the opening and closing cover 17 at the closed position.

(5) Since at least one of the plurality of protruding portions 74 formed along the axial direction of the rotation shaft J is provided at a position where the hand hooking portion 17*a* is provided in the axial direction of the rotation shaft J, it is possible to stably suppress the deviation of the opening and closing cover 17 at the closed position by the plurality of protruding portions 74.

(6) Since the hand hooking portion 17*a* is provided at the center portion of the opening and closing cover 17 in the axial direction of the rotation shaft J, the bending deformation is uniformed by the force acting on the hand hooking portion 17*a* of the opening and closing cover 17, and it is possible to stably suppress the deviation of the opening and closing cover 17 at the closed position.

(7) Since the rib 77 provided on the opening and closing cover 17 faces the second eaves portion 64 at the open position, it is possible to suppress entering of foreign materials between the opening and closing cover 17 and the second eaves portion 64 at the open position. In addition, an inside of the printing apparatus 11 is difficult to be seen, there is an advantage in design properties.

(8) Since the rotation of the opening and closing cover 17 at the open position is regulated, it is possible to easily attach and detach the opening and closing cover 17 at the open position by being easily bent and deformed.

(9) Since the second eaves portion 64 which is an example of the mounting portion side deformation regulating portion is provided on a distal end of the first eaves portion 63, in the mounting portion 26, it is possible to suppress expansion of a region necessary for providing the deformation regulating portion and the rotation regulating portion and to suppress increase of the printing apparatus 11 in size.

(10) Since an opposite side on a side facing the protruding portion 74 of the first eaves portion 63 is a flat surface when the opening and closing cover 17 is present at the open position, mounting or releasing of the container 25 is easily mounted in or released from the mounting portion 26 by the opening and closing cover 17 at an open position.

(11) Since the protruding portion 74 is provided on one end side (lower end side) of the opening and closing cover 17, a rotation regulating portion on the opening and closing cover 17 is formed near the rotation shaft J, and it is possible to suppress expansion of an occupation region in which a rotation regulation portion is provided.

(12) Since the cover side rotation regulating portion and the cover side deformation regulating portion are provided at a position where the opening and closing cover 17 becomes a front and a rear in a direction of being bent and deformed in the protruding portion 74 which is an integral member, it is possible to suppress expansion of a region necessary for providing the deformation regulating portion and the rotation regulating portion on the opening and closing cover 17 and to suppress increase of the printing apparatus 11 in size.

(13) Since the protruding portion 74 and the second eaves portion 64 is positioned on one end (lower end side) of the first eaves portion 63 in the rotation between the open position and the closed position of the opening and closing cover 17, when the container 25 is attached to and detached from the mounting portion 26 through the inserting hole 31, it is possible to suppress interfere of the deformation regulating portion or the rotation regulating portion in attaching and detaching.

(14) Since the protruding portion 74 is moved over the rotation shaft J in a direction intersecting with an axis of the rotation shaft J in association with rotation between the open position and the closed position of the opening and closing cover 17, a posture is significantly changed due to the movement of the protruding portion 74. Therefore, the protruding portion 74 is easily moved to positions respectively facing the second eaves portion 64 and the first eaves portion 63. In addition, the printing apparatus 11 can be also compact.

(15) Because of the locking mechanism disposed one end side of both ends of the opening and closing cover in the axial direction of the rotation shaft, rotation and moving of the opening and closing cover at the closed position from the closed position to the open position can be suppressed.

Also, the embodiment described above may be changed as follows. In addition, a modification example may be further obtained by appropriately combining combinations of each modification example hereinafter.

The locking mechanism may be disposed on at least one of both ends of the opening and closing cover 17 in the mounting portion case 60 in the axial direction of the rotation shaft J. That is, the locking mechanism may be disposed on a right side or both ends of a right side and a left side of the opening and closing cover 17 in the mounting portion case 60 in the axial direction of the rotation shaft J. In addition, the displacement member 47 may be configured to be inserted to the mounting portion case 60 side from the opening and closing cover 17. Otherwise, the printing apparatus 11 may include the locking mechanism that regulates rotation of the opening and closing cover 17 from the closed position to the open position.

The protruding portion 74 may not be moved over the rotation shaft J in a direction intersecting with an axis of the rotation shaft J in association with the open position and the closed position of the opening and closing cover 17. A front surface of the protruding portion 74 may be needed to be moved to a position where the protruding portion does not come into contact with the second eaves portion 64 when the opening and closing cover 17 is bent and deformed.

The protruding portion 74 and the second eaves portion 64 may not be positioned on a lower end side (one end side) of the first eaves portion 63 in the rotation between the open position and the closed position of the opening and closing cover 17. For example, in a case in which the opening and closing cover is provided at a position where the protruding portion 74 and the second eaves portion 64 comes into contact with each other the opening and closing cover 17 is bent and deformed, the second eaves portion 64 may be formed to be positioned on an upper end side of the first eaves portion 63.

The cover side rotation regulating portion may not be provided at positions where the cover side rotation regulating portion and the cover side deformation regulating portion are provided so as to become a front and a rear in a direction where the opening and closing cover is bent and deformed. In addition, in this case, the cover side rotation regulating portion and the cover side deformation regulating portion may be formed as a separate portion.

Figure 12:
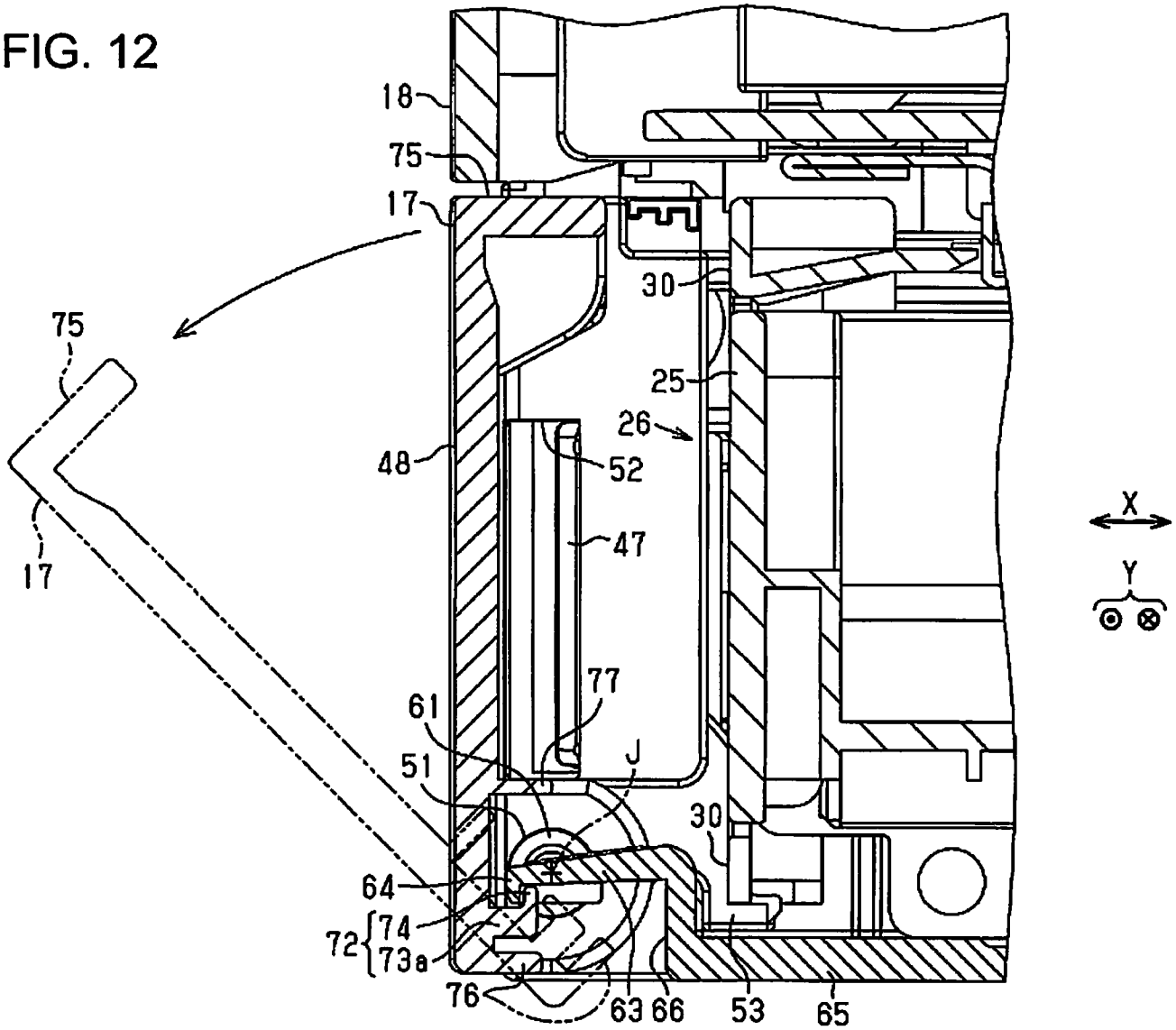
FIG. 12 is a side sectional view illustrating a part of the opening and closing cover at a closed position and the mounting portion of a modification example.
Figure 13:
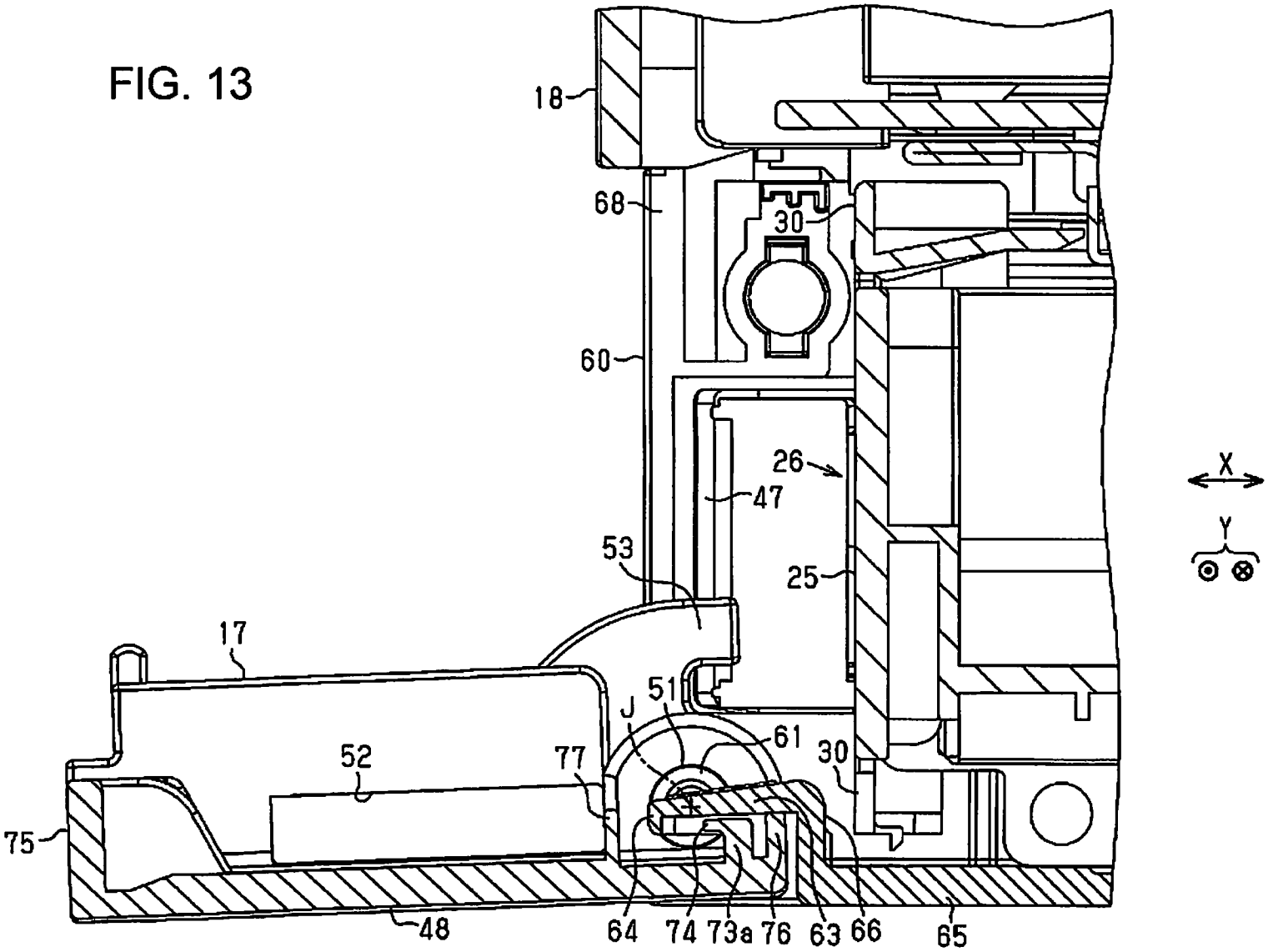
FIG. 13 is a side sectional view illustrating a part of the opening and closing cover at an open position and the mounting portion of the modification example.

With reference to FIGS. 12 and 13, this modification example will be described. Also, in FIGS. 12 and 13, the same reference number is given to the same configuration member as that of the embodiment described above, and description thereof will be appropriately omitted.

As illustrated in FIG. 12, in the modification example, the protrusion shaped portion 72 provided on the opening and closing cover 17 includes an inner wall portion 73*a* which has a gap with the lower side wall 76 and protrudes from a rear side along the lower side wall 76 in the depth direction X with a predetermined thickness, and the protruding portion 74 which protrudes upwardly from an end portion on an opposite side of the main wall 48 side in the inner wall portion 73*a* in a state in which the opening and closing cover 17 is present at the closed position.

Regarding the protruding portion 74 of the modification example, in the same manner as that of the embodiment described above, in a state in which the opening and closing cover 17 is present at the closed position, the front surface thereof is disposed on the opening and closing cover 17 to face the second eaves portion 64 in a state in which there is no gap or a slight gap is included in the depth direction X. In addition, the protruding portion 74 is positioned on one end side of the opening and closing cover 17 and is provided at a position farther toward the one end side (lower side) of the opening and closing cover 17 than a center shaft of the shaft pin 61. Therefore, as illustrated by a two-dot chain line in FIG. 12, in association with rotation of the opening and closing cover 17 from the closed position to the open position around the shaft pin 61, the protruding portion 74 is moved so that the front surface thereof facing the second eaves portion 64 is separated downwardly and backwardly.

As illustrated in FIG. 13, in the modification example, the opening and closing cover 17 is moved (rotated) from the closed position to the open position when the upper side wall 75 side is rotated at substantially 90 degrees in a front direction around the shaft pin 61. In a state in which the opening and closing cover 17 is moved to the closed position, a distal end portion of the lower side wall 76 opposite to the main wall 48 side faces the first eaves portion 63 of the mounting portion case 60 and comes into contact with (contact in an abutment state) the first eaves portion 63 at the open position of the opening and closing cover 17. Therefore, in the modification example, a position where the lower side wall 76 comes into contact with the first eaves portion 63 becomes the open position of the opening and closing cover 17, and functions as the cover side rotation regulating portion. That is, the lower side wall 76 which functions as the cover side rotation regulating portion is formed as a separate member from the protruding portion 74 which functions as the cover side deformation regulating portion.

The cover side rotation regulating portion may not be provided on one end side of the opening and closing cover 17, that is, on a side in which the bearing portion 51 is provided. For example, the protruding portion 74 (protrusion shaped portion 72) may be provided on the other end side of the opening and closing cover 17 which becomes an opposite side of the side in which the bearing portion 51 is provided, or a center part. Of course, in this case, the second eaves portion 64 is provided at a position where the opening and closing cover 17 comes into contact with the protruding portion 74 in a case of being bent and deformed in a state in which the opening and closing cover 17 is present at the closed position.

On the first eaves portion 63 which is an example of the mounting portion side rotation regulating portion, when the opening and closing cover 17 is present at the open position, an opposite side (upper side) of a side facing the protruding portion 74 which is an example of the cover side rotation regulating portion may not be a flat surface. That is, when the opening and closing cover 17 is present at the open position, the upper side of the first eaves portion 63 may be a unevenness surface or a curved surface as long as the upper is formed in a shape does not interfere in mounting or release of the container 25 to and from the mounting portion 26.

The first eaves portion 63 which is an example of the mounting portion side rotation regulating portion may not be formed to be integral with the second eaves portion 64 which is an example of the mounting portion side deformation regulating portion. That is, a contact member which comes into contact with the protruding portion 74 which is an example of the cover side rotation regulating portion when the opening and closing cover 17 is present at the closed position may be provided as a separate member from the first eaves portion 63 in the mounting portion case 60 as the mounting portion side rotation regulating portion.

The mounting portion side rotation regulating portion may be provided on the mounting portion 26 side. Otherwise, the cover side rotation regulating portion may not be provided on the opening and closing cover 17 side. That is, in a case in which the open position of the opening and closing cover 17 does not need to be specified, a regulating portion for regulating the rotation of the opening and closing cover 17 may not be provided.

The rib 77 facing the second eaves portion 64 which is an example of the mounting portion side deformation regulating portion at open position may not be provided on the opening and closing cover 17. For example, in a case in which probability of entering of foreign materials between the opening and closing cover 17 and the second eaves portion 64 is low when the opening and closing cover 17 is present at the open position, the rib 77 may not be provided.

The hand hooking portion 17*a* may not be provided on the center portion of the opening and closing cover 17 in the axial direction (width direction Y) of the rotation shaft J. That is, the hand hooking portion 17*a* may be provided one end portion of both ends of the opening and closing cover 17 in the width direction Y.

A plurality of the protruding portions 74 which is an example of the cover side deformation regulating portion may be formed along the axial direction of the rotation shaft J. That is, one protruding portion 74 may be provided at a position where the hand hooking portion 17*a* is provided in the axial direction of the rotation shaft J. In addition, the eaves shaped portion 62 of the mounting portion case 60 may be formed to be divided into a plurality of parts in the width direction Y in accordance with the number of the protruding portions 74 (protrusion shaped portion 72).

The hand hooking portion 17*a* for rotating from the closed position to the open position may not be provided on the opening and closing cover 17. Otherwise, the protruding portion 74 which is an example of the cover side deformation regulating portion may not be provided at a position where the hand hooking portion 17*a* is provided in the axial direction of the rotation shaft J.

The protruding portion 74 which is an example of the cover side deformation regulating portion may not be provided at a position farther toward the lower side wall 76 side which is one end side of the opening and closing cover 17 than the rotation shaft J. For example, in a state in which the opening and closing cover 17 is present at the closed position, in a height direction, the protruding portion may be provided at a position the same as that of the rotation shaft J, or may be provided at a position upper than the rotation shaft J.

The protruding portion 74 which is an example of the cover side deformation regulating portion may not be provided on the one end side of the opening and closing cover 17, that is, on a side in which the bearing portion 51 is provided. For example, the protruding portion 74 (protrusion shaped portion 72) may be provided on the other end side of the opening and closing cover 17 which becomes an opposite side on a side where the bearing portion 51 is provided or in the center part. Of course, in this case, the second eaves portion 64 is provided at a position where the opening and closing cover 17 comes into contact with the protruding portion 74 when being bent and deformed in a state in which the opening and closing cover 17 is positioned at the closed position.

One end side where the rotation shaft J of the opening and closing cover 17 is provided may be an upper end side of the opening and closing cover 17. That is, the rotation shaft J is preferably provided on any one side of an upper end and a lower end near the opening and closing cover 17 in the longitudinal direction.

A medium is not limited to the paper P, may be a plastic film or the like.

The printing apparatus 11 may be a so-called line head type printer having a configuration in which the nozzle 38 is formed over the entire region in the width direction Y without moving the recording head 39, as the printing unit 28, in addition to a configuration in which the recording head 39 supported by the carriage 40 reciprocates along the guide shaft 41 installed in the carriage 40 and inside the case 12 and extends in the width direction Y. Otherwise, a laser printer may be used.

What is claimed is:

1. A printing apparatus comprising:

a printing unit that performs printing on a medium;

a container that accommodates a printing-related member relating to the printing by the printing unit;

a mounting portion that includes an opening and on which the container is detachably mounted through the opening; and an opening and closing cover that rotates around a rotation shaft provided on one end side of the opening and closing cover between an open position where the opening is open and a closed position where the opening is closed, wherein the mounting portion is provided with a mounting portion side deformation regulating portion, the opening and closing cover is provided with a cover side deformation regulating portion disposed to face a position where the opening and closing cover comes into contact with the mounting portion side deformation regulating portion in a case in which bending deformation is generated in a direction where the opening and closing cover disposed at the closed position is opened, and the cover side deformation regulating portion is provided on the one end side of the opening and closing cover on which the rotation shaft is provided.

2. The printing apparatus according to claim 1, wherein the cover side deformation regulating portion is provided at a position farther toward the one end side of the opening and closing cover than the rotation shaft.

3. The printing apparatus according to claim 1, wherein the opening and closing cover is provided with a hand hooking portion for rotation from the closed position to the open position, and wherein the cover side deformation regulating portion is provided at a position where the hand hooking portion is provided in an axial direction of the rotation shaft.

4. The printing apparatus according to claim 3, wherein a plurality of the cover side deformation regulating portions is formed along the axial direction of the rotation shaft, and at least one cover side deformation regulating portion is provided at a position where the hand hooking portion is provided in the axial direction of the rotation shaft.

5. The printing apparatus according to claim 3, wherein the hand hooking portion is provided at a center portion of the opening and closing cover in the axial direction of the rotation shaft.

6. The printing apparatus according to claim 1, wherein the opening and closing cover is provided with a rib facing the mounting portion side deformation regulating portion at the open position.

7. A printing apparatus comprising:

a printing unit that performs printing on a medium;

a container that accommodates a printing-related member relating to the printing by the printing unit;

a mounting portion that includes an opening and on which the container is detachably mounted through the opening; and an opening and closing cover that rotates around a rotation shaft provided on one end side of the opening and closing cover between an open position where the opening is open and a closed position where the opening is closed, wherein the mounting portion is provided with a mounting portion side deformation regulating portion, the opening and closing cover is provided with a cover side deformation regulating portion disposed to face a position where the opening and closing cover comes into contact with the mounting portion side deformation regulating portion in a case in which bending deformation is generated in a direction where the opening and closing cover disposed at the closed position is opened, a mounting portion side rotation regulating portion is provided on a side of the mounting portion, and a cover side rotation regulating portion disposed to face the position where the opening and closing cover comes into contact with the mounting portion side rotation regulating portion in rotation of the opening and closing cover from the closed position to the open position, is provided on a side of the opening and closing cover.

8. The printing apparatus according to claim 7, wherein the mounting portion side rotation regulating portion is integrally formed with the mounting portion side deformation regulating portion, the mounting portion side deformation regulating portion has a first surface which is disposed to face the cover side deformation regulating portion of the opening and closing cover in a closed state and extends in a direction where the opening and closing cover opens from the mounting portion, and wherein the mounting portion side rotation regulating portion has a second surface which is disposed to face the cover side rotation regulating portion of the opening and closing cover in an open state and extends in a direction intersecting with the direction where the opening and closing cover opens from the first surface of the mounting portion side deformation regulating portion.

9. The printing apparatus according to claim 8, wherein, in the mounting portion side rotation regulating portion, when the opening and closing cover is present at the open position, an opposite side on a side facing the cover side rotation regulating portion is a flat surface.

10. The printing apparatus according to claim 7, wherein the cover side rotation regulating portion is provided on the one end side of the opening and closing cover.

11. The printing apparatus according to claim 7, wherein the cover side rotation regulating portion is integrally formed with the cover side deformation regulating portion, and the cover side rotation regulating portion and the cover side deformation regulating portion are provided at positions so as to become a front and a rear in a direction where the opening and closing cover is bent and deformed.

12. The printing apparatus according to claim 7, wherein the cover side deformation regulating portion, the cover side rotation regulating portion, and the mounting portion side deformation regulating portion are positioned closer to the one end side of the opening and closing cover than the mounting portion side rotation regulating portion, in rotation of the opening and closing cover between the open position and the closed position.

13. The printing apparatus according to claim 7, wherein the cover side deformation regulating portion and the cover side rotation regulating portion are moved over the rotation shaft in a direction intersecting with an axis of the rotation shaft, in association with the rotation of the opening and closing cover between the open position and the closed position.

14. A printing apparatus comprising:

a printing unit that performs printing on a medium;

a container that accommodates a printing-related member relating to the printing by the printing unit;

a mounting portion that includes an opening and on which the container is detachably mounted through the opening;

an opening and closing cover that rotates around a rotation shaft provided on one end side of the opening and closing cover between an open position where the opening is open and a closed position where the opening is closed; and a locking mechanism which regulates rotation of the opening and closing cover from the closed position to the open position, wherein the mounting portion is provided with a mounting portion side deformation regulating portion, the opening and closing cover is provided with a cover side deformation regulating portion disposed to face a position where the opening and closing cover comes into contact with the mounting portion side deformation regulating portion in a case in which bending deformation is generated in a direction where the opening and closing cover disposed at the closed position is opened, and the locking mechanism includes a displacement member which is disposed at least one end side of ends of the opening and closing cover in an axial direction of the rotation shaft, and which regulates the rotation of the opening and closing cover from the closed position to the open position by being inserted from one side of the opening and closing cover and the mounting portion into the other side.

* * * * *